United States Patent [19]

King

[11] Patent Number: 5,046,888

[45] Date of Patent: Sep. 10, 1991

[54] MATERIAL SPREADER

[76] Inventor: John C. King, 3746 1st West, Birmingham, Ala. 35207

[21] Appl. No.: 29,696

[22] Filed: Mar. 24, 1987

[51] Int. Cl.[5] ..... E01C 19/18; E01C 19/38; E01C 19/22; E01C 11/24

[52] U.S. Cl. ..... 404/75; 404/108; 404/115

[58] Field of Search ..... 404/75, 115, 116, 105, 404/102, 101, 108, 110, 104, 113, 114

[56] References Cited

U.S. PATENT DOCUMENTS

| | | | |
|---|---|---|---|
| 1,979,619 | 11/1934 | Hemstreet et al. | 404/110 |
| 1,987,398 | 1/1935 | Gardiner | 404/101 |
| 2,076,890 | 4/1937 | Heltzel | 404/101 |
| 2,145,959 | 2/1939 | Venable | 404/102 X |
| 2,248,103 | 7/1941 | Mall | 404/116 |
| 2,332,687 | 10/1943 | Baily | 404/115 |
| 2,902,910 | 9/1959 | Malsbury et al. | 404/105 |
| 3,477,354 | 11/1969 | Rink | 404/105 X |
| 4,507,015 | 3/1985 | Furukawa et al. | 404/114 X |
| 4,526,493 | 7/1985 | Hall et al. | 404/105 |
| 4,678,364 | 7/1987 | Charonnat et al. | 404/105 |

*Primary Examiner*—Ramon S. Britts
*Assistant Examiner*—Nancy P. Connolly
*Attorney, Agent, or Firm*—Jennings, Carter, Thompson & Veal

[57] ABSTRACT

An aggregate material spreader which is suitable for spreading aggregate material especially concrete on driveways, roadways and other paved surfaces. Work is performed by a roller-skid assembly adequate for rolling on forms and also skidding on the ground. It may have a built-in vibrating system and screed plates to grade material off at a desired level. Because of the skid embodiment it is designed to slip form. Finally a gliding float moves over the surface smoothing out all wrinkles.

Also an alternate embodiment exists with a hopper built above the spreader with a sloping top attached on at the rear of said hopper at a lower position for concrete to discharge through for a finished product.

1 Claim, 6 Drawing Sheets

MATERIAL SPREADER

BACKGROUND OF INVENTION

The primary use for the invention lies in surfacing driveways and parking lots with concrete; especially the smaller and isolated ones, which are done by utility contractors and sometimes employees of local government. In most cases they are done by hand. Concrete work is always hard work, especially when done by hand and when the weather is hot. During this situation, the sun dries the water out very quickly causing the concrete to set very fast, thereby causing the men to use their best skills at high accelerated speeds while working under very high pressure conditions, because they are working against time. Power screeds are available. A difficulty of the power screeds is the skidding of the screeds on forms which may cause the forms to settle in certain places. This settling of forms occurs because this vibrating unit shakes the whole screed, thereby, causing low places in the concrete.

There are paving machines, but the difficulty of these is that they are too large to do certain jobs, and they are very costly for doing small jobs. They are too difficult to move from place to place; for instance, in order to move one, a person would have to move it on a trailer. For these reasons, without having a long and continuous paving job, it is totally impractical to think in terms of using a paving machine.

TECHNICAL FIELD

This invention relates to the methods of an apparatus for spreading surface material. And while not limited thereto, it relates to the spreading of concrete driveways, walks, streets, parking lots, and valley gutters.

DESCRIPTION OF THE PREFERRED EMBODIMENTS

Figure 1:
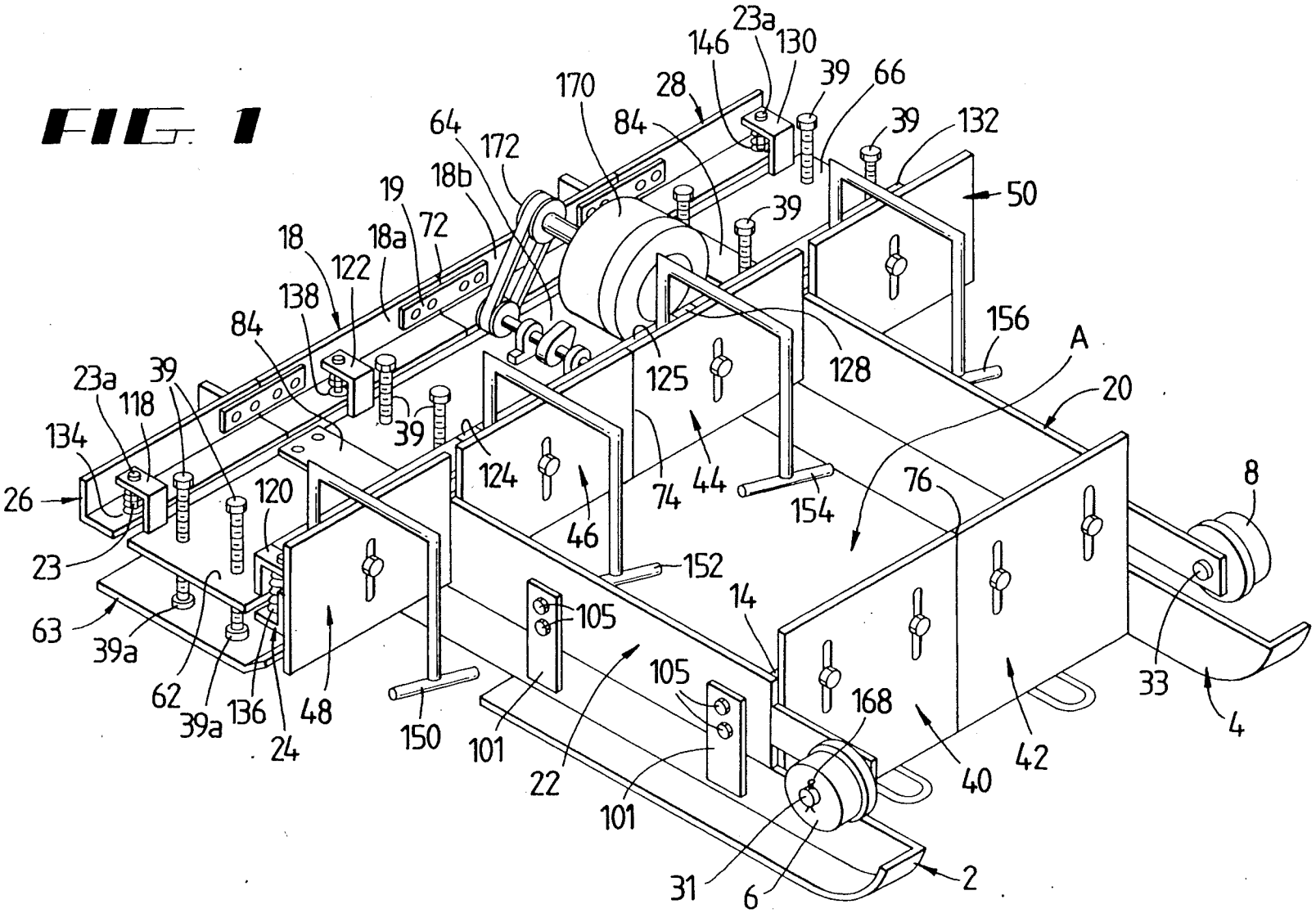

Referring to the drawings for a clearer understanding of the invention, it may be seen in FIG. 1 that my invention is an elongated material spreader which may be supported on a pair of skids 2 and 4 or on a set of rollers 6, 8, 10 and 12. A plurality of angle members 14, 16, 18 are affixed to and extend inwardly perpendicular of a pair of longitudinal frame members or 20 and 22 which are affixed to and supported on the skids 2 and 4. The separation between the skids 2 and 4 is determined by the length of angles 14, 16, and 18. As may be seen if FIG. 1 these angles as formed by a pair of angle such as 18*a* and 18*b* which are joined at points 72, 74, and 76 by a splice member 19. Thus extension angles (not shown) may be inserted to provide greater width.

A rectangular pouring area A is defined between the skids 2, 4 and angles 14 and 16. This area is where the concrete will be poured out of a ready mix concrete truck. The pour area is further defined by a plurality screed plates detachably affixed to the angles 14 and 16. As can be seen in FIGS. 1–5 screed plates 40 and 42 are carried by angle 14 and screed plates 44 and 46 are carried by angle 16. Each screed plate has a pair of vertically elongated apertures therein which receive a stud bolt which is welded to the associated angle. Thus the screed plates are vertically adjustable.

For joining concrete poured into pouring area A to preexisting concrete, I provide a pair of lateral wings formed by a wing angles 24, 26, 28 and 30 which carry screed plates 48 and 50 to screed concrete poured between skid 2 or 4 and the existing concrete.

My vibrator mechanism is shown in FIGS. 1–3 and 6–8. I use a vibrator float including a pluraiity of horizontal plates 62, 64, and 66. Plates 64 are carried by angles 16 and 18 and connected thereto by spring angles 122, 124, 126 and 128 which are welded to the top of plate 64. To minimize vibration to the apparatus, each spring angle is supported by a spring 138, 140, 142 and 144 respectively. Each spring 138, 140, 142 and 144 is coaxially mounted about a bolt 23 engaged in and extending upwardly from apertures in angles 16 and 18. Each spring angle has a hole therein aligned with bolt 23 such that the bolt passes therethrough. A nut 23*a* is secured to each bolt 23 above each spring angle.

Figure 3:
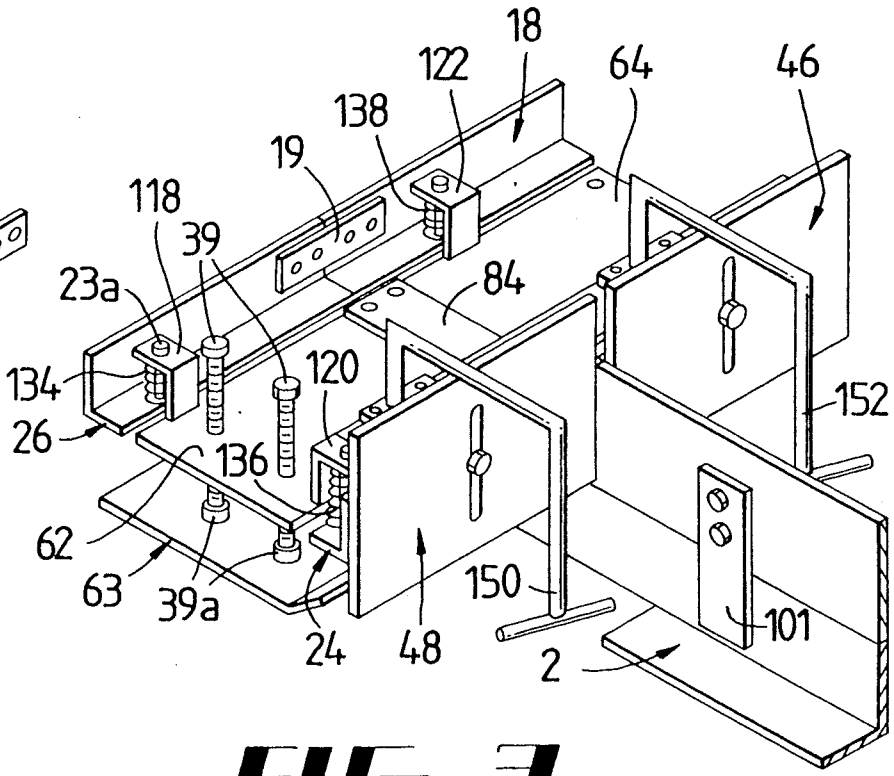
Figure 2:
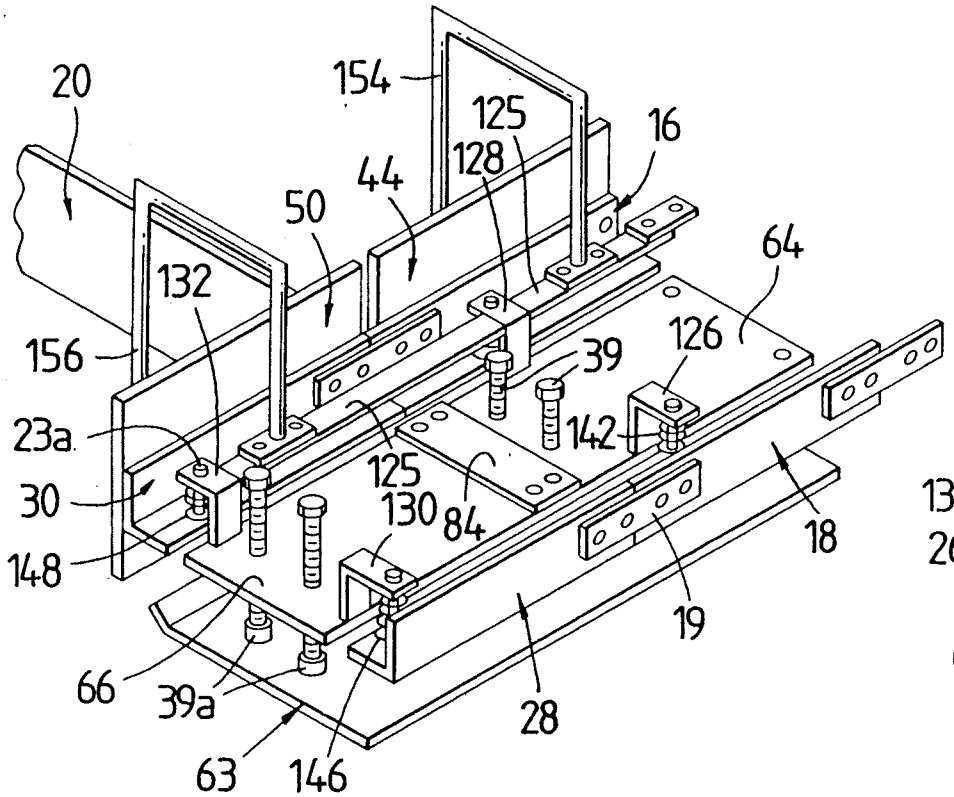
Figure 1:
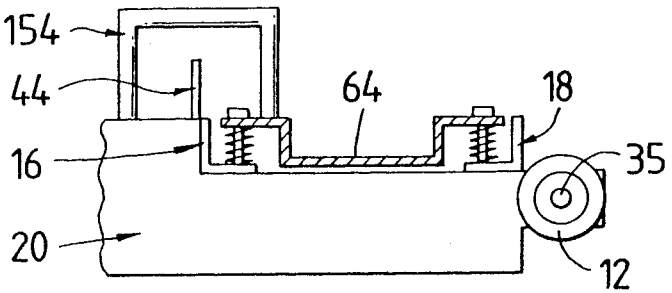
Figure 5:
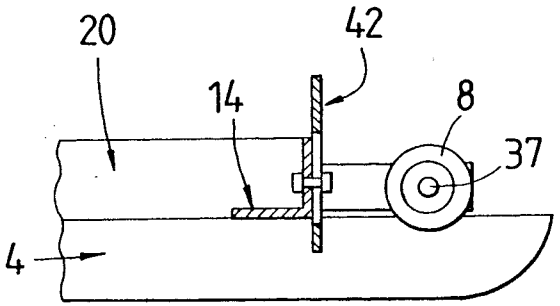
Figure 6:
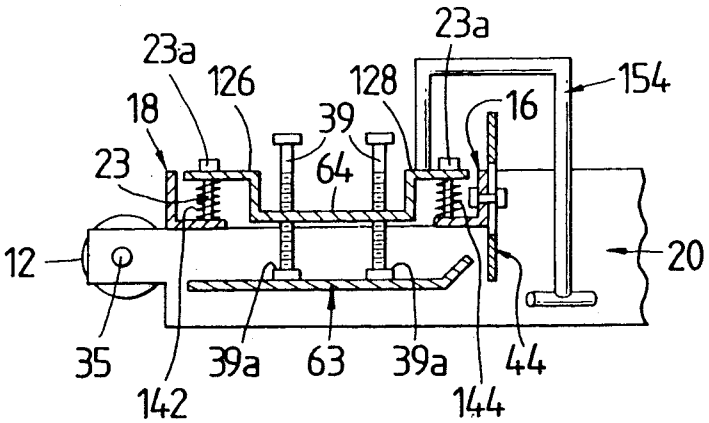
Figure 4:
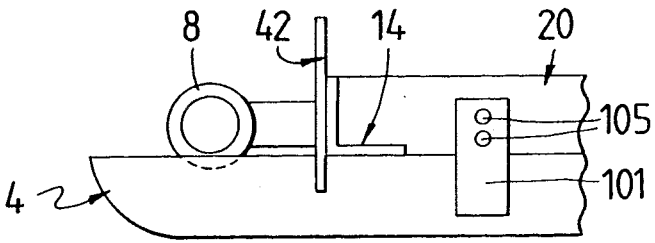
Figure 8:
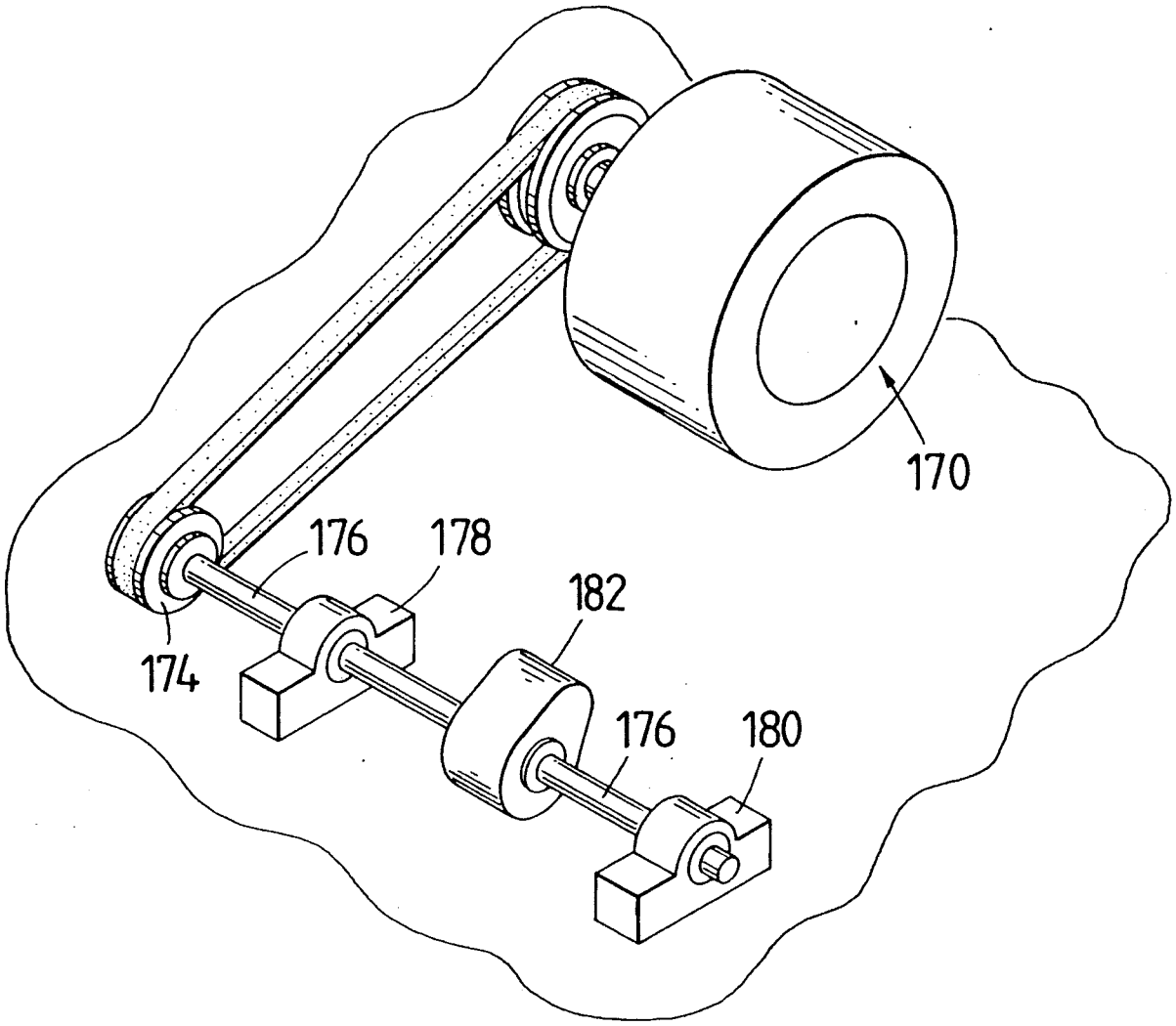

As seen most clearly in FIGS. 1–3 spring angles 128 and 124 carry intermediate frame members 125 which have mounted thereto tubing members 152 and 154 which extend over screed plates 44 and 46 and into the pouring area A. The vibrating system is powered by a gasoline motor 170 mounted on plate 64 to which is also mounted a shaft 176 supported on pillow blocks 178 and 180. One end of the shaft 176 carries a pulley 174 which is connected by a belt 173 to a pulley 172 mounted to and driven by motor 170. Shaft 176 has mounted thereon an eccentric weight 182 which create an imbalance in the rotating shaft 176 and causes the system to vibrate.

A float pan 63 is carried beneath the plate 64 by a plurality of bolts 39 threaded through apertures in plate 64 and engaged within a receiving nut 39*a* welded to the upper surface of float pan 63. Note that if wings are used then angles 24, 26, 28 and 30 support plates 62 and 66 on springs 134, 136, 146 and 148 and beneath spring angles 118, 120, 130, 132 and the float pan is supported therebeneath in the same manner as beneath plates 64. The plates 62, 64 and 68 may be joined by splice plate bracket 84 having cooperative nuts and apertures to permit a bolted connection. The float pan 63 can be adjusted vertically by varying the engagement of bolts 39 through the plates 62, 64 and 66. Tubing member 150 and 156 are supported in the same manner as members 152 and 154.

Note that the apparatus may be used without the skids 2 and 4, though the use of rollers 6, 8, 10 and 12 which would allow the apparatus to roll along a form (not shown). Axles 31, 33, 35 and 37 are welded to extension of side plates 20 and 22 such that rollers 6, 8, 10 and 12 may be mounted thereon and secured thereto by cotter pins 168 passing through holes in the axles.

When this embodiment is used, the apparatus is pulled in the direction of travel by connection to a pair of pulling loops by a winch, tractor, ready mix concrete truck or other equipment, (not shown) with the ready mix concrete truck moving concomitantly with the apparatus depositing a suitable amount of concrete in the pouring area and/or in the area between the preexisting concrete and the skids. The motor 170 imparts vibration to the tubing 150, 152, 154 and 156 which is submerged in the concrete for the purpose of vibrating the concrete prior to screeding by plates 44, 46, 49 and 50 to cut the concrete to the desired height. Subsequent to screeding the float pan 63 of the vibrator float vibrates the surface of the concrete to bury the aggregate to provide a suitable topping. The skids 2 and 4, which are connected by plates 101 and bolts 105 have upturned end portion for smooth skidding and provide a means for moving the apparatus and simultaneous slip forming.

Figure 9:
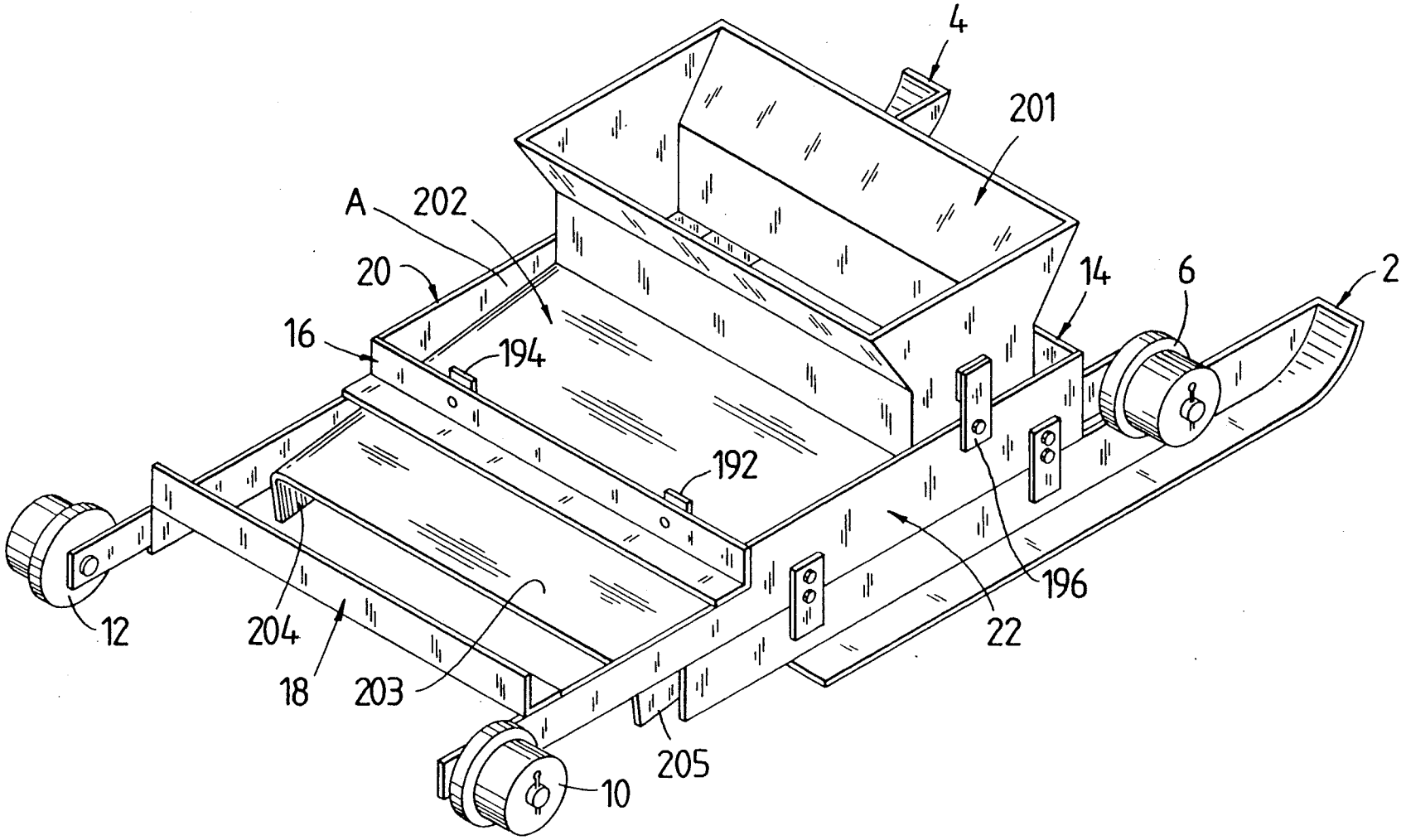
Figure 10:
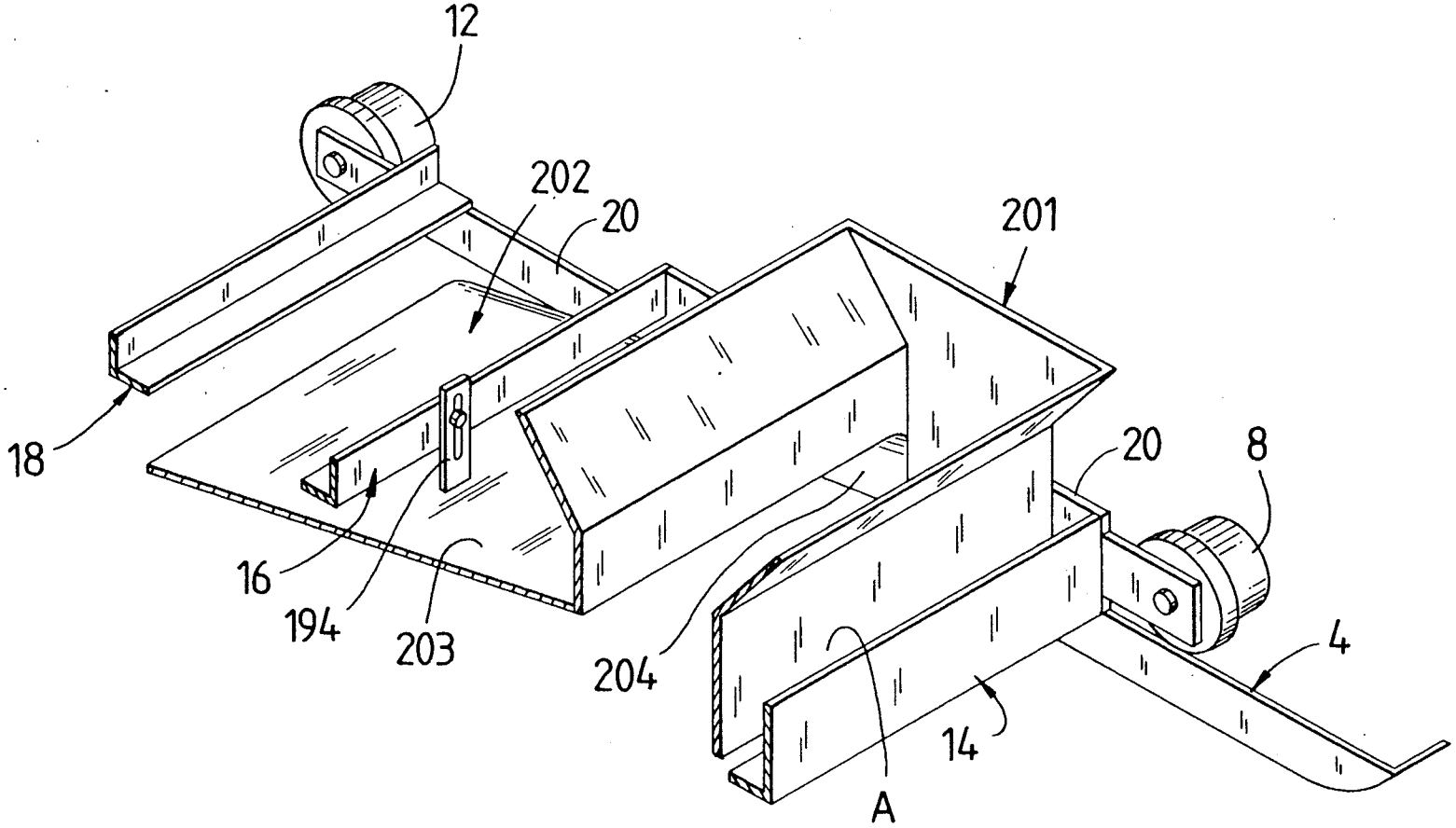

An alternate embodiment is shown in FIGS. 9 and 10. In this embodiment a hopper 201 extends across the width of the apparatus and is mounted between panels 20 and 22 near angle 14. The hopper 201 extends upwardly above the panels 20 and 22 to form a reservoir in which concrete may be poured to yield greater pressure on the bottom concrete to aid in solidification. The front of the hopper 201 extends downwardly to the ground in the same manner as screed plates 40 and 42 while the rear of the hopper terminates at a selected distances above the ground. A metal attachment 202 having a top 203, and sides 204 and 205, only one of which is shown, and being open on the bottom is attached to the rear of the hopper 201 at the lower edge thereof. The attachment 202 extends downwardly and rearwardly to allow concrete to exit the spreader rearwardly as the spreader is pulled in a forward direction. It is to be understand that the vibration system is removed from between angles 16 and 18 and the hopper 201 and attached are inserted in the pouring area A and fastened to the side panels using bracket 196 on each side. The metal attachment 201 also has metal plates 192 and 194 welded to the top 203 and extending upwardly therefrom. Plates 192 and 194 have vertical slots therein such that they may be bolted to angle 16 and are adjustable to raise or lower the attachment to provide a desired thickness of expelled concrete. If vibration of the concrete becomes necessary a portable vibrator unit may be used.

While I have shown my invention in various forms, it will be obvious to those skilled in the art that it is not so limited but is susceptible of various changes and modifications without departing from the spirit thereof.

I claim:

1. An apparatus for finishing paving material comprising:

a frame having four sides defining an opening for dispensing paving material, said sides having means for changing the lengths;

skid means, for supporting said frame on a attached to the underside of two opposing sides of the frame and extending beyond the ends of said two opposing sides, said two opposing sides including means for detachably fastening a hopper;

roller means attached to two corners of said sides adjacent one end of said skid means ends; one of said sides between said skid means, having a first vertically adjustable screed means and means for attaching a cable to move said apparatus; the side opposite the one said side between said skid means, extends beyond said two opposing sides and including a second vertically adjustable screed means;

plate means disposed between said side opposite the one said side and the other of said two opposing sides ends, one end of said plate means resiliently attached to said side opposite the one said side, said plate means having a plurality of submergible-type vibrating means fixed to the upper surface of said plate means, said submergible-type vibrating means extending from said plate means top into said dispensing opening to contact paving material, said plate means other end resiliently attached to a support means, said support means fixed to said two opposing sides other ends, said two opposing sides other ends including roller means attached adjacent thereto;

adjustable float pan means resiliently attached beneath said plate means and extending between said side opposite the one said side and said two opposing sides other ends; and vibrator means attached to the upper surface of said plate means to vibrate said adjustable float pan means;

wherein said plate means resilient attachments minimize vibration to the frame of said apparatus.

* * * * *